US005402620A

United States Patent [19]

Perobelli et al.

[11] Patent Number: 5,402,620

[45] Date of Patent: Apr. 4, 1995

[54] DEVICE AND METHOD FOR CLOSING AND LATERALLY SEALING PLASTIC FILM WRAPPED BUNDLES CONTAINING SHEETS OR THE LIKE

[75] Inventors: Aldo Perobelli; Giorgio Pessina, both of Milan, Italy

[73] Assignee: O.M.G. di Giorgio Pessina e Aldo Perobelli S.n.c., Milan, Italy

[21] Appl. No.: 99,779

[22] Filed: Jul. 29, 1993

Related U.S. Application Data

[63] Continuation of Ser. No. 906,763, Jun. 30, 1992, abandoned.

[30] Foreign Application Priority Data

Jul. 5, 1991 [IT] Italy ..... M191A1868

[51] Int. Cl.[6] ..... B65B 7/02

[52] U.S. Cl. ..... 53/371.9; 53/372.6

[58] Field of Search ..... 53/463, 372.6, 374.9, 53/218, 371.8, 371.9; 493/475, 478, 479

[56] References Cited

U.S. PATENT DOCUMENTS

| | | | |
|---|---|---|---|
| 736,634 | 8/1903 | Robinson | 53/371.9 |
| 1,641,042 | 8/1927 | Marrasso . | |
| 2,008,271 | 7/1935 | Zeigler | 53/463 X |
| 2,052,717 | 9/1936 | Littlefield | 53/371.9 |
| 2,814,920 | 12/1957 | Darrow . | |
| 2,928,217 | 12/1957 | Case et al. . | |
| 3,242,635 | 3/1966 | Kobick | 493/479 X |
| 3,527,019 | 9/1970 | Furrer | 53/218 X |
| 3,685,253 | 8/1972 | Herrell et al. | 53/218 X |
| 3,724,164 | 4/1973 | Brevko | 53/371.9 |
| 4,148,170 | 4/1979 | Gaubert | 53/463 X |
| 4,498,895 | 2/1985 | White | 493/478 X |
| 4,574,561 | 3/1986 | Dirico | 493/475 X |

FOREIGN PATENT DOCUMENTS

| | | |
|---|---|---|
| 1586349 | 3/1971 | Germany . |
| 2045678 | 11/1980 | United Kingdom . |

*Primary Examiner*—Linda B. Johnson

*Attorney, Agent, or Firm*—Dann, Dorfman, Herrell and Skillman

[57] ABSTRACT

A device is described for closing and laterally sealing plastic film wrapped bundles containing sheets or the like, by wrapping them in a thermally shrinkable plastic film, which comprises two sealing plates (25,26) suitable to be moved against lateral opposite sides of a bundle (29) for sealing them. These plates (25,26) are preferably hinged on two slides (2,3) suitable to be contemporaneously either approached or moved apart from each other as a function of the width of the bundle (29) to be laterally sealed. Two nozzles (31,32) are moreover provided, which form air jets against laterally protruding portions (30) of the plastic film, so that said protruding portions are easily folded by said plates (25,26). A so closed and sealed bundle is then carried inside an oven for thermally shrinking the wrapped film.

2 Claims, 3 Drawing Sheets

DEVICE AND METHOD FOR CLOSING AND LATERALLY SEALING PLASTIC FILM WRAPPED BUNDLES CONTAINING SHEETS OR THE LIKE

This is a continuation of application Ser. No. 07/906,763, filed Jun. 30, 1992, now abandoned.

The present invention relates to a device and a method for closing and laterally sealing plastic film wrapped bundles containing sheets or the like, by wrapping a bundle in thermally shrinkable plastic film.

Such a technical problem has been already studied and a solution is described in the patent U.S. Pat. No. 2,928,217 which is an example of existing prior art. According to said patent, once the bundle has been wrapped in a plastic film, the film lateral portions are sealed by suitable welders. The drawback of such a realization is due to the fact that usually a too large plastic sheet is employed, i.e. protruding from the bundle lateral sides, so that the excess has to be cut out and sucked for the discharging thereof, and this causes a drawback as the device must provide a sucker, thus involving higher costs for the realization and use thereof.

In the realization of said patent U.S. Pat. No. 2,928,217, in order to avoid such discharging of the film excess, also measured sheets are employed which have not any waste, but in such case tearings are disadvantageously caused in the film lateral portions when these portions are sealed to each other.

The device forming the object of the present invention allows to eliminate the above mentioned drawbacks with the features and advantages which are clearly pointed out in the following description of a non-limiting embodiment of the device itself, made with reference to the attached drawings in which.

Figure 1:
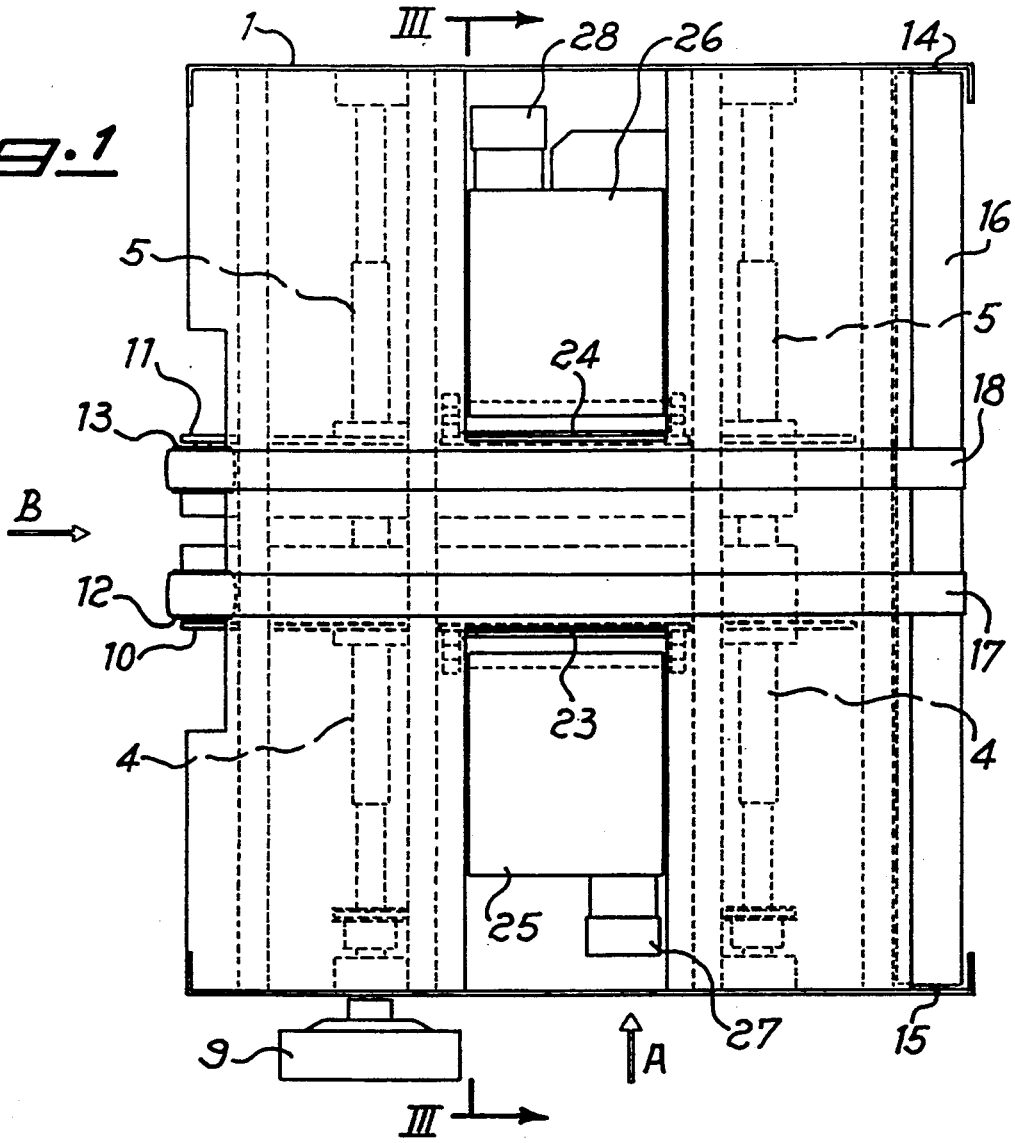
FIG. 1 is a plan view of the device.
Figure 2:
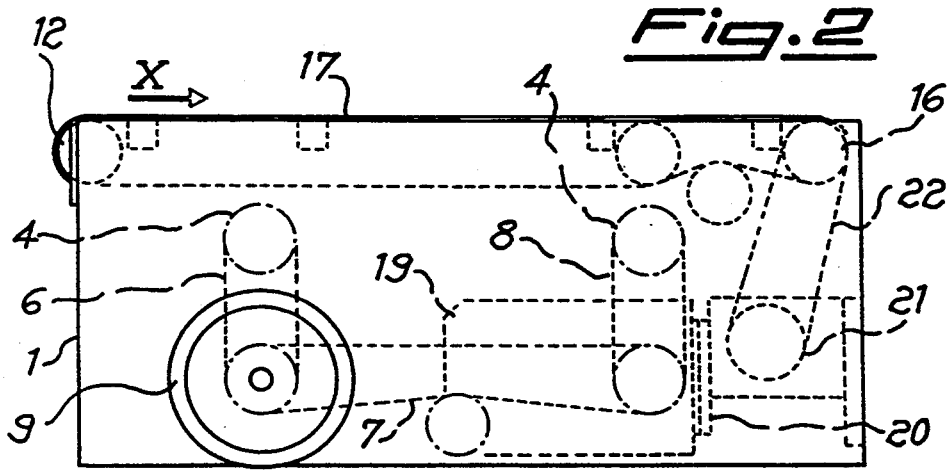
FIG. 2 is a side view of the device, according to the arrow A in FIG. 1.

Referring to the attached drawings, this device includes a base 1 inside which two opposite slides 2 and 3 are mounted, on which two pairs of screws 4 and 5 are mounted and connected to each other by chains or belts 6, 7 and 8 which are moved by means of a manually actuatable handwheel 9. The screws 4 and 5 with respective female screws formed in the slides 2 and 3 are respectively right-threaded and left-threaded, so that through the manual operation of the handwheel 9 the slides 2 and 3 respectively move apart or approach to each other in correspondence with the direction of rotation of the handwheel itself, as a function of the width of the bundle.

Above the slides 2 and 3, on one side supports 10 and 11 are fixed respectively supporting pulleys 12 and 13, while on the opposite side of the base 1 two supports 14 and 15 are fixed supporting a roller 16. A conveyor belt 17 is wound between the pulley 12 and the roller 16, and a conveyor belt 18 is similarly wound around the pulley 13 and the roller 16.

Consequently, when the handwheel 9 rotates the conveyor belts 17 and 18 move integrally with the slides 2 and 3.

Figure 4:
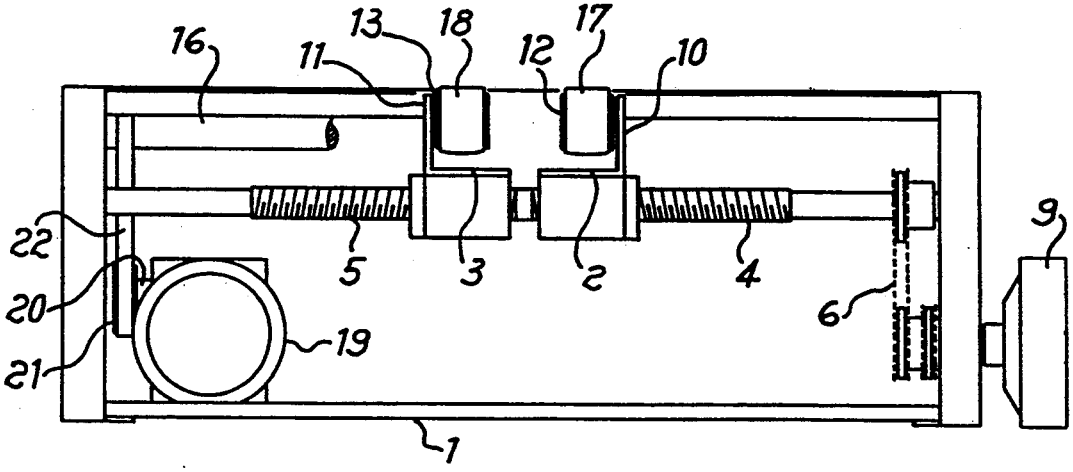
FIG. 4 is a side view of the device, according to the arrow B in FIG. 1.

As it is seen in particular in FIG. 4, in a lower part of the base 1, on the opposite side with respect to the handwheel 9, an electric motor 19 is arranged which is connected through a reduction gear 20 of known type to a pulley 21, which is connected to the roller 16 by means of a belt 22. Said roller 16 is connected to the pulleys 12 and 13, so that the conveyor belts 17 and 18 move contemporaneously according to the arrow X, when the motor 19 is rotating.

Figure 3:
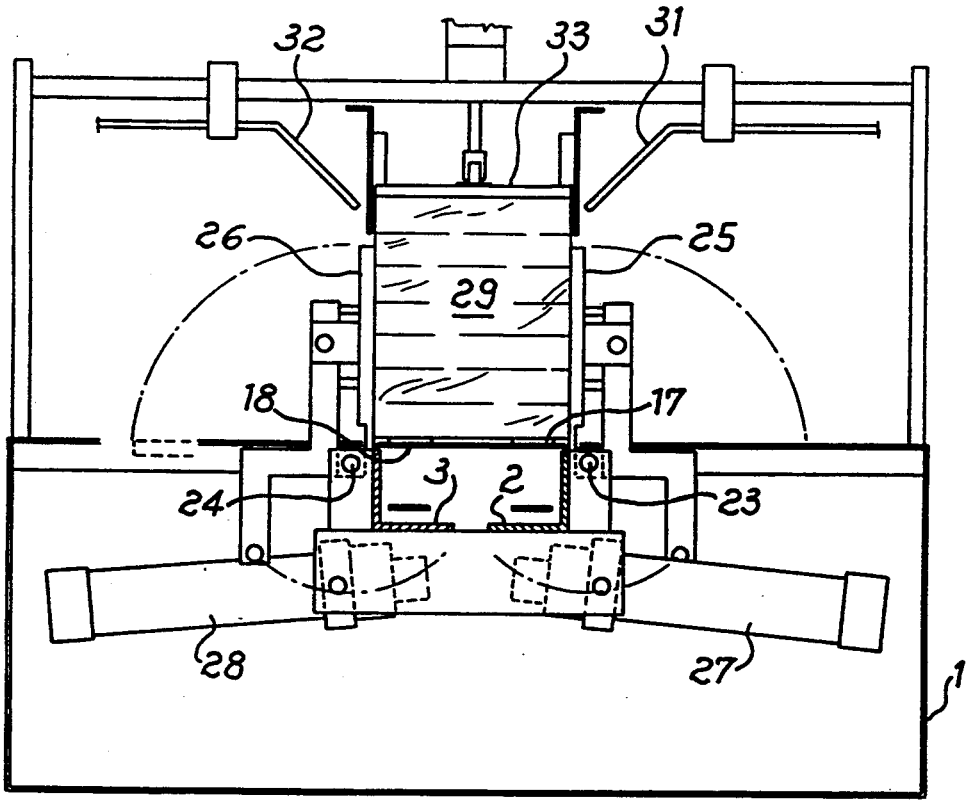
FIG. 3 is a section of the device, taken along the line III—III in FIG. 1.

Sealing plates 25 and 26 are connected to said slides 2 and 3, in particular by hinges 23 and 24, and are moved from the horizontal position of FIG. 1 to the vertical position of FIG. 3 or vice versa, by means of pneumatic cylinders 27 and 28.

Figure 5:
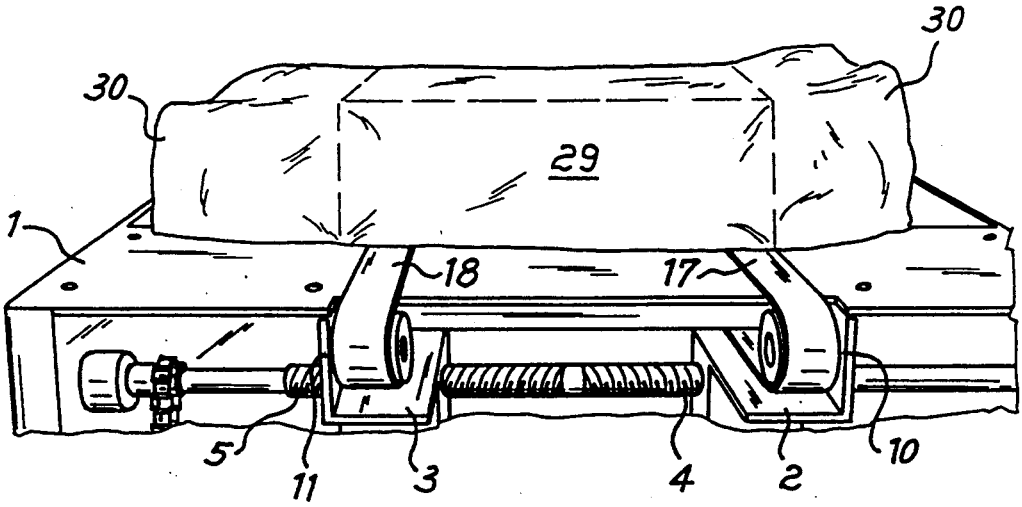
FIG. 5 is a perspective view of the device with a bundle after the plastic film has been wrapped therearound.
Figure 6:
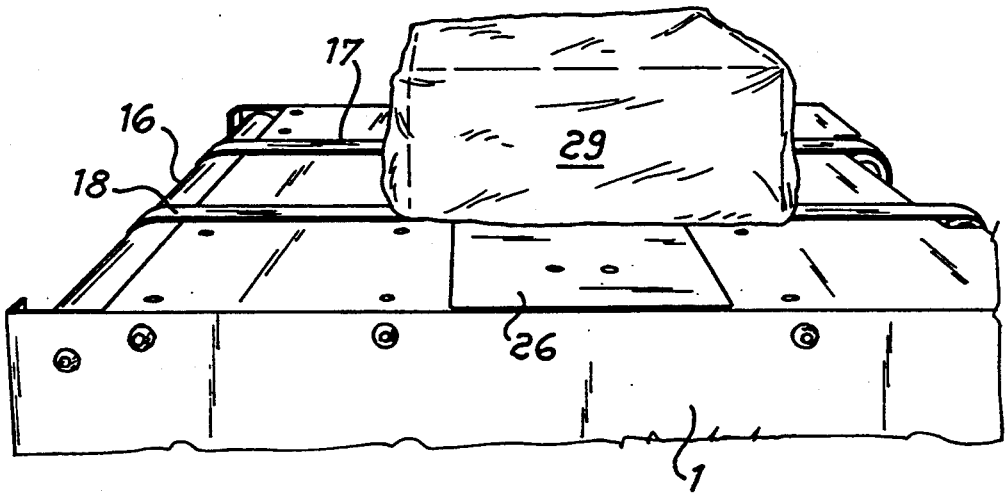
FIG. 6 is a perspective view of the device with a bundle after the wrapping film has been laterally sealed.

In FIG.5 a bundle 29 wrapped by thermally shrinkable plastic film is shown, containing sheets or the like, coming from a sealing film applying machine of known type which is placed side by side to the base 1 of the present device, on the side of the pulleys 12 and 13, so that the so wrapped bundle 29 is carried by the conveyor belts 17 and 18, in the direction of the arrow X, precisely in correspondence with the plates 25 and 26. Suitable sensors not shown in the drawing cause the bundle to stop in a correct position and control the plates which pass from the horizontal position to the vertical position so that these, by pushing on the protruding portions 30 of the plastic film, fold and seal said portions, thus converting the bundle to the shape shown in FIG.6. The sealing plates 25 and 26 return to the horizontal position after having performed, in the vertical position, said sealing.

For making easier to fold such protruding portions, two nozzles 31,32 are provided in correspondence with the plates and connected to said pneumatic cylinders 27 and 28 so that, while the plates 25 and 26 pass from the horizontal position to the vertical position, the air coming out of the cylinders passes through said nozzles, thus forming air jets which push on said protruding portions of the plastic film.

After said sealing operation, the so formed bundle is carried, by the conveyor belts 17 and 18, out of the present device and inside an oven of known type, not shown in the drawings, placed side by side to said base 1, on the side of roller 16, to obtain the thermal shrinking of the film which wraps the bundle.

An upper presser 33 is possibly provided as well, in correspondence with the plates 25 and 26, which acts on the top of the bundle, in such a way to keep the film in a correct position, this condition being useful but not essential to have a good lateral sealing of the bundle.

Moreover the pulleys 12 and 13, are convex to ensure the traction of the conveyor belts 17 and 18 when the slides 2 and 3 change their position.

The operation of the device and consequently the method for laterally sealing the bundles takes place as follows:

first of all the distance between the slides 2 and 3 is adjusted as a function of the width of the bundle, then the plastic film wrapped bundle, coming from a sealing film applying machine, automatically has a slowing down followed by the stopping of the bundle in correspondence with the sealing plates 25 and 26 which provide the lateral sealing. Again automatically, the spreading of the plates follows as well as the discharge of the bundle towards the oven for thermally shrinking the wrapping film.

From the above description the advantages of the invention are the following:

possibility to have a perfect lateral sealing of the thermally shrinkable plastic film which wraps the bundle for every width of the latter, by means of simple adjusting means;

formation of perfectly closed bundles at the outlet of the oven for thermally shrinking, without any possibility of tearings in the film which wraps the bundle;

lateral closing of the bundles without any sucking device to eliminate excess portions cut out from the plastic film.

Clearly, variations and/or modifications can be brought to the device according to the present invention without thereby exceeding the scope of protection of the invention as hereinunder claimed.

We claim:

1. A device for closing and laterally sealing plastic film wrapped bundles containing sheets or the like, by wrapping a bundle in thermally shrinkable plastic film, comprising: two sealing plates suitable to be pushed against opposite sides of the bundle for sealing protruding portions of said plastic film; two pneumatic cylinders connected to said sealing plates for rotation of said plates from a horizontal position to a vertical position, said opposite sides of the bundle being pushed by said plates in vertical position; two conveyor belts transferring said bundles between said plates; two nozzles through which air jets pass pushing against said protruding portions for folding the latter during the rotation of said sealing plates from the horizontal position to the vertical position said air jets being formed by the air discharged by said cylinders during the approaching of said plates to the bundle.

2. A device for closing and laterally sealing plastic film wrapped bundles containing sheets or the like, by wrapping a bundle in thermally shrinkable plastic film, comprising: two sealing plates suitable to be pushed against opposite sides of the bundle for sealing protruding portions of said plastic film; two pneumatic cylinders connected to said sealing plates for rotation of said plates from a horizontal position to a vertical position, said opposite sides of the bundle being pushed by said plates in vertical position; two conveyor belts transferring said bundles between said plates; two slides hinged to said sealing plates and supporting said pneumatic cylinders and said conveyor belts; means connected to said slides adapted to contemporaneously either approach or move apart from each other said slides; and two nozzles through which air jets pass pushing against said protruding portions of said plastic film for folding the latter during the rotation of said sealing plates from the horizontal position to the vertical position, said air jets being formed by the air discharged by said cylinders during the approaching of said plates to the bundle.

* * * * *